United States Patent [19]

Kuchinsky et al.

[11] 4,254,361

[45] * Mar. 3, 1981

[54] MULTI-DIGIT DISPLAY APPARATUS

[75] Inventors: Saul Kuchinsky, Somerville, N.J.; Roger W. Wolfe, San Diego, Calif.; Thomas C. Maloney, Bernardsville; William M. Hennessey, Somerville, both of N.J.

[73] Assignee: Burroughs Corporation, Detroit, Mich.

[ * ] Notice: The portion of the term of this patent subsequent to Sep. 9, 1992, has been disclaimed.

[21] Appl. No.: 554,595

[22] Filed: Mar. 3, 1975

Related U.S. Application Data

[60] Division of Ser. No. 391,373, Aug. 24, 1973, Pat. No. 3,903,448, which is a continuation of Ser. No. 188,485, Oct. 12, 1971, abandoned, which is a continuation of Ser. No. 870,678, Oct. 27, 1969, abandoned.

[51] Int. Cl.[3] ..... H01J 17/49; H01J 61/067; HO1J 61/66

[52] U.S. Cl. ..... 313/519; 313/190; 313/217

[58] Field of Search ..... 313/517, 519, 217, 210, 313/190

[56] References Cited

U.S. PATENT DOCUMENTS

| | | | |
|---|---|---|---|
| 2,686,273 | 10/1954 | Hough et al. | 313/190 |
| 3,327,154 | 6/1967 | Bowerman | 313/519 |
| 3,588,571 | 6/1971 | Vemura et al. | 313/210 X |

FOREIGN PATENT DOCUMENTS

| | | | |
|---|---|---|---|
| 43-24119 | 10/1968 | Japan | 313/519 |
| 44-10414 | 5/1969 | Japan | 315/169 |

*Primary Examiner*—Palmer C. Demeo

*Attorney, Agent, or Firm*—Kevin R. Peterson; Robert A. Green

[57] ABSTRACT

A display device adapted to display one or more characters side by side in a row and including an insulating support plate, on the top surface of which are formed a plurality of groups of conductive members, each group being adapted to be energized to display a character. The device includes various configurations of anode electrodes, shielding electrodes, and interconnections of common characters in each group to provide manufacturing economies.

5 Claims, 5 Drawing Figures

Fig. 1
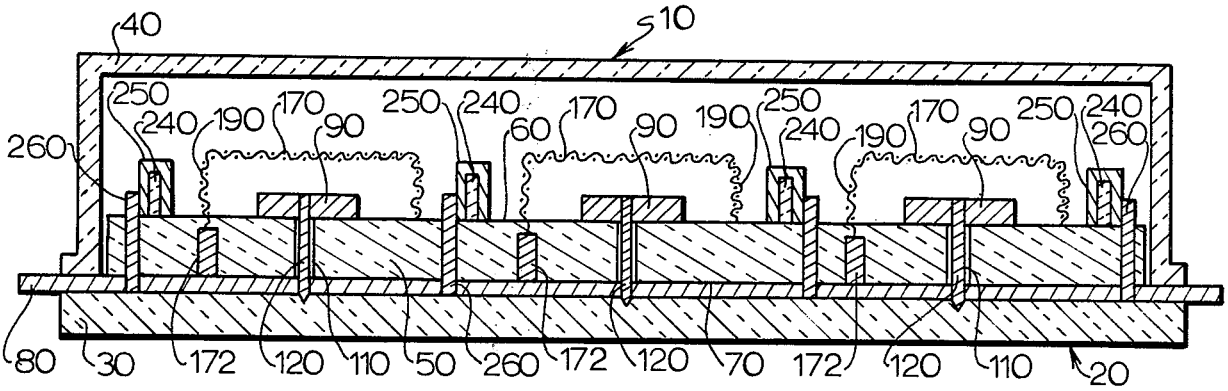
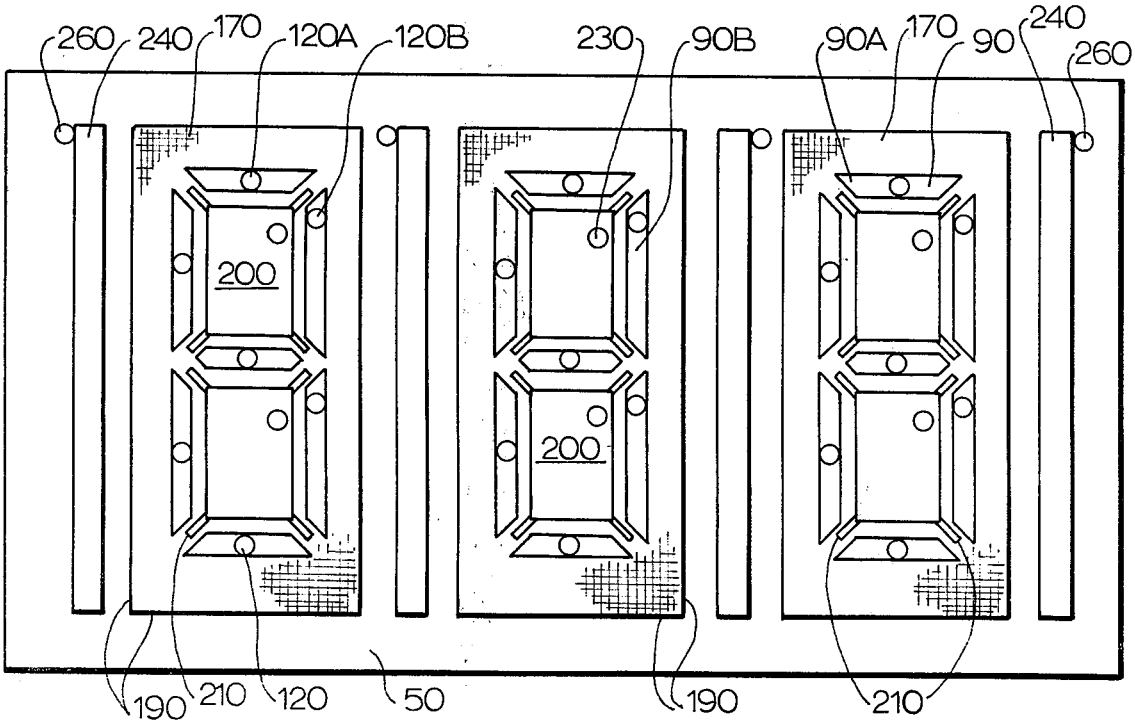
Fig. 2

MULTI-DIGIT DISPLAY APPARATUS

CROSS-REFERENCE TO RELATED APPLICATIONS

This application is a division of Ser. No. 391,272, filed Aug. 24, 1973, now Pat. No. 3,903,448, as a continuation of application Ser. No. 188,485, now abandoned, filed Oct. 12, 1971, as a continuation of Ser. No. 870,678, filed Oct. 27, 1969, and now abandoned.

BACKGROUND OF THE INVENTION

For many years now, indicator tubes such as the NIXIE tube of Burroughs Corporation have been widely used in all types of instruments for providing a numerical readout of an electronic circuit logic operation. Such instruments usually include three or more of such tubes, and electronic calculators may include as many as sixteen or more.

According to the present invention, an economic saving can be effected by building the indicator tubes in groups, that is, by providing more than one group of cathode numerals in a single tube envelope, as has been the practice up to now. The present invention provides a novel indicator tube or device including a plurality of groups of cathode electrodes which can be used to display more than one numeral at a time and having novel electrode interconnections and electrode structures.

DESCRIPTION OF THE DRAWING

FIG. 1 is a sectional elevational view of a display device embodying the invention;

FIG. 2 is a plan view of the device of FIG. 1;

DESCRIPTION OF THE PREFERRED EMBODIMENT

Figure 3:
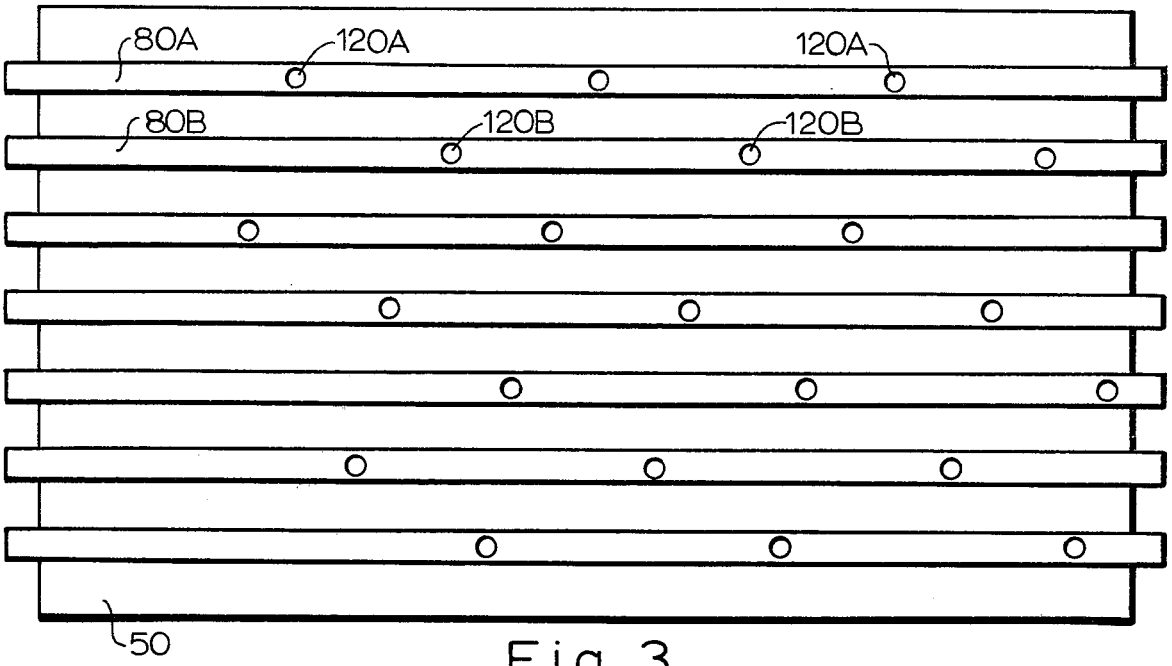
FIG. 3 is a plan view of the bottom surface of a portion of the device of FIG. 1.

Display device 10 embodying the invention includes a glass envelope 20 which is filled with a gas such as argon, neon, or the like which can support cathode glow. The envelope includes a base 30 and viewing window 40 which is secured to the base and encloses the various functional elements of the device which are supported on the base 30.

The functional elements of device 10 include an insulating plate 50, of glass, ceramic, or any suitable material which is supported on base 30 and has a top surface 60 and a bottom surface 70. The plate 50 may be held in place by electrodes to be described, or it may be secured to the base by a glass-to-glass seal, by a suitable cement, by metal pins, or the like (not shown). Metallic leads or runs 80 are interposed between plate 50 and base 30 for a purpose to be described.

A plurality of identical groups of cathode character elements 90 are positioned on the top surface 60 of the insulating plate 50. These cathode character elements 90 may be flat strips of metal, wires, or, preferably, films or coatings of a conductive material such as a mixture of powdered molybdenum and powdered manganese or powdered molybdenum and powdered titanium which is screened or sprayed on the top surface of plate 50.

Such a film or coating might also be plated with nickel or otherwise treated.

The cathode elements 90 are formed in groups of seven, three such groups being shown side-by-side (FIG. 2) so that three numerals or other characters can be displayed side-by-side at the same time by energizing selected cathodes in each group. In FIG. 1, the cathodes 90 are shown as linear segments which can be combined in different groups to represent different characters such as numbers or letters. Of course, more than seven or fewer than seven elements might be provided, as desired.

Electrical contact may be made to each cathode element in different ways. In one arrangement, an aperture 110 is provided in the insulating plate 50 directly beneath a portion of each cathode element, with the apertures associated with corresponding elements in each group being at the same general position on the plate to facilitate making common connections thereto as discribed below. However, the aperture associated with one cathode is at a different location than the aperture associated with the other cathodes in its group so that a straight line can be drawn interconnecting each corresponding aperture without any of the lines crossing each other. Each aperture 110 carries a conductive member 120 which makes electrical contact with its cathode and extends downwardly to the bottom surface 70 of plate 50. The conductive lining 120 may be a conductive coating or a pin or a wire which makes suitable contact with its cathode element.

A separate conductive lead or run 80 (FIG. 3) is connected to each terminal or hole conductor 120 on the bottom surface of the insulating plate, with each lead 80 being connected to the terminal associated with the same cathode element in each group of elements. Thus, for example, the top conductor 80A interconnects contacts 120A to each of the top horizontal cathodes 90A (FIG. 2), the next lower conductor 80B interconnects contacts 120B associated with the upper right cathodes 90B (FIG. 2), etc. The leads 80 may be flat metal conductors prepared by a photochemical etching process, or they may be individual strips held in place mechanically or by a cement, between the plate 50 and the base 30 of the envelope and extending through glass-to-metal seals in the wall of the envelope to provide portions outside the envelope, to which external circuit contact can be made. If the conductors 80 are individual strips, they may be soldered to the hole conductors 120, or they may have apertures into which the hole conductors, if they are pin-like, are pressed and held by a mechanical tight fit.

The conductors 80 may extend through one or both ends of the envelope, or some may extend through one end, and the others may extend through the opposite end.

The device 10 also includes a separate anode electrode 170 for each group of cathode elements. The anodes may take many different forms, and in one arrangement, each anode is a generally flat, thin rectangular fine mesh screen which covers its group of cathode elements and has four side panels 190 which are bent down along all four sides of the cathode arrays. The anodes may be held in place by means of tabs 172 or the like secured to panels 190 and inserted in the holes in plate 50. In addition, one or more such tabs may extend through plate 50, to a conductor 80 on the bottom surface of plate 50 whereby electrical contact may be made separately to each anode.

The anode electrode for each group of elements might comprise, alone or in combination with the screens 170, a conductive film or coating 200 (FIG. 2) of relatively large size formed between the upper four segments and between the lower four cathode segments 90 (FIG. 2) and including radiating arms 210 which might comprise film or wires and which extend into and lie between the adjacent ends of the cathode segments. Electrical contact may be made to this anode structure also through the plate 50, for example, by means of pins 230 which make contact to a suitable conductor arrangement 80 (not shown) on the bottom surface of plate 50.

In order to isolate adjacent groups of cathode and anode electrodes from each other, a rib or wall 240 of insulating material is provided between adjacent groups, and preferably these ribs carry a metal shield coating 250. Electrical contact may be made to this shield coating by means of suitable pins 260 or the like which pass through plate 50 to suitable conductors. In addition, if the insulating sheet is of a ceramic material, the ribs 240 may be formed when the sheet is formed as an integral portion thereof.

Figure 4:
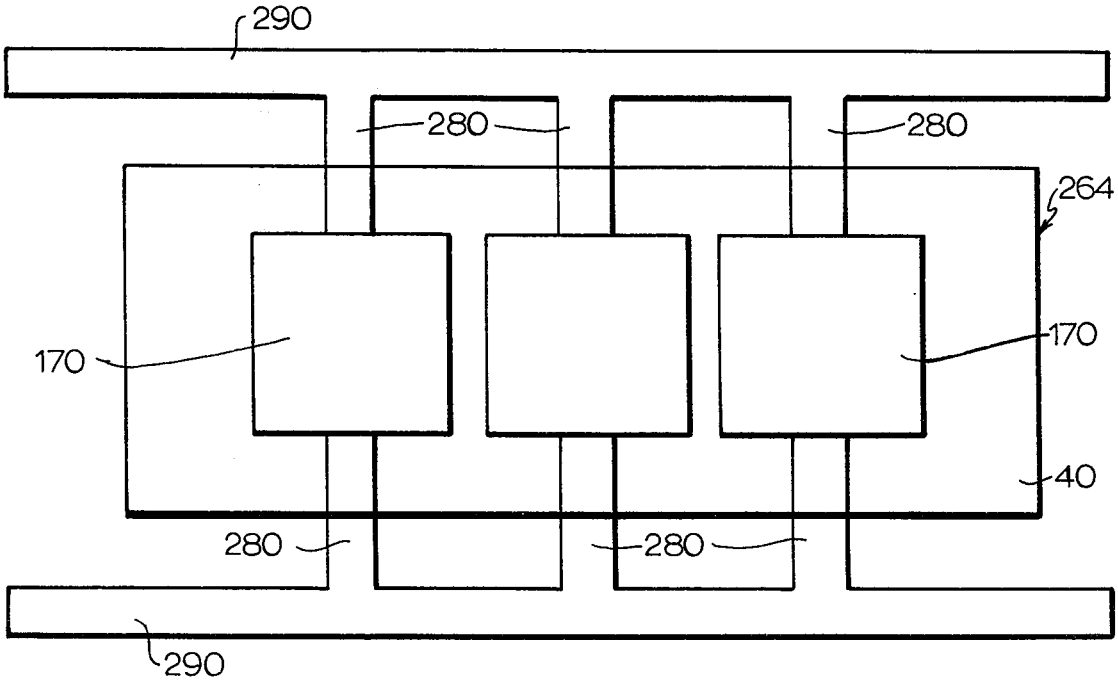
FIG. 4 is a plan view of a modification of a portion of the invention.

In one convenient anode arrangement used in manufacturing the device 10 and referring to FIG. 4, the anode screens 170 are connected together in a unitary assembly 264 by leads 280 projecting from opposite ends of each anode to a common horizontal plate lead 290. This structure can be prepared in a single electrochemical etching operation from a flat piece of metal. During manufacture of the device 10, the anode assembly 264 is set in place, and the anode leads 180 are sealed between the viewing window and the base. Then the leads 280 are cut, for example, where they join the leads 290, to remove the common leads and thus to separate the anode screens from each other.

Figure 5:
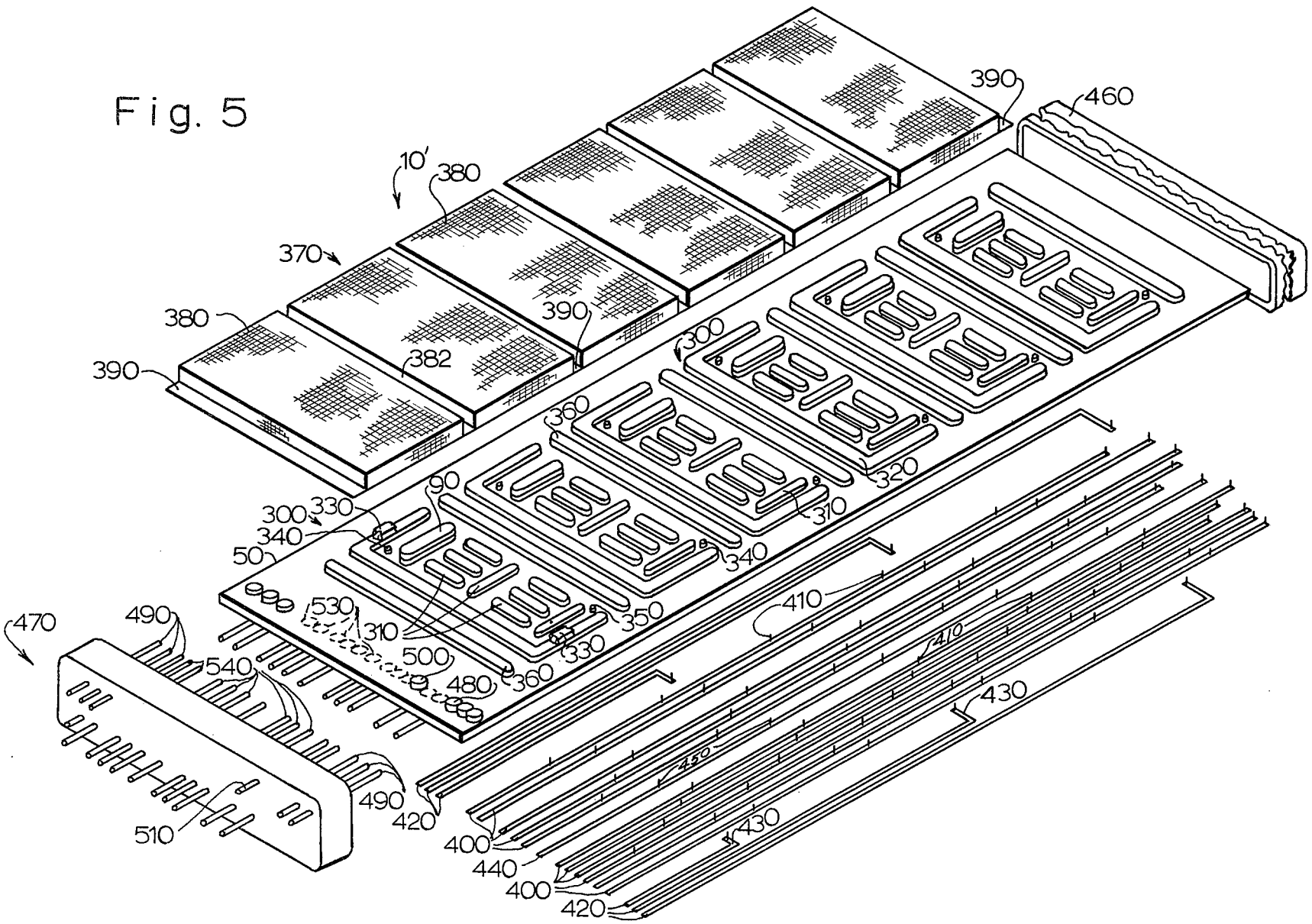
FIG. 5 is an exploded view of another panel embodying the invention.

Another panel 10', shown exploded in FIG. 5, includes all of the elements of the panel 10 with modifications of portions thereof. In panel 10', insulating plate 50 includes insulating elevations or ridges 300 on which the various electrodes of the panel are supported. Nine elevations 310 are shown in each group for supporting cathode electrodes 90 which, for convenience, are shown only on two elevations in the first group of elevations 300. An elevation 320 is provided for supporting the anode electrode 330 which is shown as C-shaped and enclosing the cathode elevations 310 and cathodes 90 on three sides. If space permits, the anode could completely surround the cathodes.

Panel 10' also includes auxiliary elevations 340 for supporting auxiliary cathodes 350 (only one of which is shown) which are shaped to represent decimal points. Of course, they may also be shaped as commas or the like. Two such auxiliary electrodes are provided at diagonally opposed corners so that the panel can be oriented as shown or turned 180°, while retaining an auxiliary electrode or decimal point in its proper operating position.

Panel 10' also includes linear elevations 360, positioned between each group of electrodes, for supporting an electrostatic shield 370. The electrostatic shield is shown as a unitary structure including a large-area screen 380 which overlays each group of electrodes, side panels 382 which lie between groups of electrodes, and a support plate 390 between each of the screens and adapted to be seated on the elevation 360.

Panel 10' includes conductive runs 400 on the bottom surface of plate 50 for making connection to the cathodes 90 by way of pins 410. Runs 420 connect to each one of the anodes 330 by pins 430, and run 440 connects to the shield 370 by pins 450.

Panel 10' (and panel 10) is mounted in a generally flat, elongated envelope 460, and it includes a header 470 which carries pins for making contact to the runs 400, 420, and 440. As part of the connecting arrangement to the header, the plate 50 is provided at one end with a series of pins 480, three near one edge and three near the other, which extend through the plate 50 and are welded or soldered on the bottom surface to anode runs 420. The pins 480 are contacted adjacent to the top surface of plate 50 by pins 490 in header 470. Run 440 is similarly connected to pin 500, and this is contacted by pin 510 in header 470. The cathode runs 400 are secured to pins 530 adjacent to the bottom surface of plate 50, and these pins are contacted by pins 540 in header 470. It is to be noted that this arrangement provides easy electrical connection to the various panel electrodes by having the pins in the header arrayed in two rows.

It will be clear to those skilled in the art that modifications may be made in the various structures described within the scope of the invention. For example, although one theory would indicate that continuous sputtered metal paths will not form between the anode arms 210 and the adjacent cathodes (FIG. 2), it may be desirable to roughen or groove the surface of plate 50 between these elements to prevent such paths from forming. In addition, the cathode and anode materials and the material of the insulating plate 50 may be any one of many well known materials. The method of preparation of the various parts may also be varied as required.

What is claimed is:

1. A multi-digit display apparatus comprising an electrode board having a plurality of display sections and a transparent plate which is transparent at least for portions facing the individual display sections, said transparent plate and electrode board being stacked, the stack being hermetically sealed around the periphery thereof, said electrode board carrying a plurality of cathode elements arranged in digit-8 groups for the individual display sections, and anodes formed in portions surrounded by the individual cathode elements and in portions surrounding the individual cathode elements for each said digit-8 group, said anodes being commonly connected in each said display section and to a terminal for each said display section and corresponding cathode elements in each said display section being electrically connected with each other and to a terminal for each said element, the total area of the anodes in each display section being greater than the total cathode area in that section.

2. A multi-digit display apparatus comprising an insulating base plate having a plurality of display sections and a transparent face plate which is transparent at least for portions thereof facing the individual display sections, said transparent face plate and base being stacked, the stack being hermetically sealed around the periphery thereof to form an envelope, said base plate carrying a plurality of cathode elements arranged in digit-8 groups for the individual display sections, and anodes formed in portions surrounded by the individual cathode elements and in portions surrounding the individual cathode elements for each said digit-8 group, said anodes being commonly connected in each said display section and to a terminal for each said display section and corresponding cathode elements in each said display section being electrically connected with each other and to a terminal for each said element, the total area of the anodes in each display section being greater than the total cathode area in that section.

3. The display apparatus defined in claim 2 wherein said anode portions which are surrounded by individual cathode elements are generally rectangular in shape.

4. The display apparatus defined in claim 2 wherein said anode portions which are surrounded by individual cathode elements are generally rectangular in shape and said portions which surround the individual cathode portions are screens which are supported on said base plate.

5. The display apparatus defined in claim 2 wherein said anode portions which are surrounded by individual cathode elements are generally rectangular in shape and said portions which surround the individual cathode portions are screens which are supported on said base plate and overlie said cathode elements.

* * * * *